US005079856A

United States Patent [19]

Truelsen

[11] Patent Number: 5,079,856

[45] Date of Patent: Jan. 14, 1992

[54] SHOE SOLE

[75] Inventor: Ejnar Truelsen, Tonder, Denmark

[73] Assignee: A/S Eccolet Sko, Bredebro, Denmark

[21] Appl. No.: 476,462

[22] PCT Filed: Dec. 5, 1988

[86] PCT No.: PCT/DK88/00203

§ 371 Date: Jun. 6, 1990

§ 102(e) Date: Jun. 6, 1990

[87] PCT Pub. No.: WO89/05105

PCT Pub. Date: Jun. 15, 1989

[30] Foreign Application Priority Data

Dec. 8, 1987 [DK] Denmark ..... 6448/87

[51] Int. Cl.[5] ..... A43B 13/00

[52] U.S. Cl. ..... 36/25 R; 36/28

[58] Field of Search ..... 36/25 R, 27, 28, 34 R, 36/32 R

[56] References Cited

U.S. PATENT DOCUMENTS

| | | | |
|---|---|---|---|
| 3,100,354 | 8/1963 | Lombard et al. | 36/25 R |
| 4,096,649 | 6/1978 | Saurwein | 36/32 R |
| 4,259,792 | 4/1981 | Halberstadt | 36/28 |
| 4,521,979 | 6/1985 | Blaser | 36/28 X |
| 4,697,361 | 10/1987 | Ganter et al. | 36/28 |
| 4,741,114 | 5/1988 | Stubblefield | 36/32 R |
| 4,785,557 | 11/1988 | Kelley et al. | 36/32 R |
| 4,918,838 | 4/1990 | Chang | 36/28 |

FOREIGN PATENT DOCUMENTS

| | | | |
|---|---|---|---|
| 89/0896 | 10/1989 | World Int. Prop. O. | 36/25 R |
| 89/11047 | 11/1989 | World Int. Prop. O. | 36/28 |

*Primary Examiner*—Paul T. Sewell
*Assistant Examiner*—Beth Anne Cicconi
*Attorney, Agent, or Firm*—Mason, Fenwick & Lawrence

[57] ABSTRACT

A shoe sole (1) manufactured of one or more pieces of a resilient material, such as plastics, natural or synthetic rubber, including a recess extending from below the heel and forward to the forefoot. The recess only allows the longitudinal circumferential rims of the shoe sole to come into contact with the walking surface when the user of the shoe is standing on said walking surface. A shock-absorbing projection (2) is provided in the recess opposite the heel bone of the foot, said projection not coming into contact with the walking surface at a low pressure load. At a high pressure load, such as when the user is walking or running, the shock-absorbing projection (2) comes into contact with the walking surface. In this manner the shocks usually affecting the heel of the shoe are moved to the heel bone as well as absorbed in the best possible manner. When the user is standing still the resilience is achieved by the circumferential rim of the shoe sole absorbing all the pressure in the heel area. The optimum absorption of shocks when the user of the shoe is walking and running is achieved by the pressure in the heel area being absorbed by the projection (2) situated just below the heel bone of the foot.

21 Claims, 1 Drawing Sheet

SHOE SOLE

TECHNICAL FIELD

The invention relates to a shoe sole manufactured of one or more pieces of a resilient material, such as plastics, natural or synthetic rubber.

BACKGROUND ART

European Publication No. 83449 A discloses a running shoe comprising a sole made of one piece of resilient material, where the rear portion of the heel is inclined and the heel includes a groove. As the heel is primarily supported by the circumference of the sole it cannot absorb all shocks opposite the correct position on the heel bone of the user.

FR-PS No. 2402425 discloses furthermore a shoe sole where the heel is provided with a knob. The knob provides no shock-absorption, and the heel per se is not a resilient portion.

DISCLOSURE OF INVENTION

The object of the invention is to provide a shoe sole of the above type which allows a better shock-absorption in the heel area than the previously known soles.

The shoe sole according to the invention is characterised in that a recess extends from below the heel and forward to the forefoot, said recess allowing only the longitudinal circumferential rims of the shoe sole below the heel to come into contact with the walking surface when the user of the shoe is standing on said walking surface, and that a shock-absorbing projection is provided in the recess opposite the heel bone of the foot, said projection only coming into contact with the walking surface at a high pressure load, such as when the user is walking or running, and not at a low pressure load. In this manner the shocks usually affecting the heel of the shoe when the user is walking or running are moved to the heel bone as well as absorbed in the best possible manner. The optimum absorption of shocks at usual pressure loads is achieved by the circumferential rim of the shoe sole absorbing the entire pressure load in the heel area, whereas the projection situated just below the heel bone of the foot provides the optimum non-shocking transfer of the shocks to the heel bone and consequently to the legs and spine of the user when the foot is subjected to maximum pressure loads.

An embodiment of the shoe sole according to the invention is characterised in that the projection forms part of the midsole, and that the projection extends through an opening or a rim recess in the outsole. As a result the most resilient and poorest wear-resisting material, i.e. the projection, comes last into contact with the walking surface, i.e. the ground, because most of the outsole and the longitudinal circumferential rim are manufactured in such a manner that a highly wear-resisting sole is achieved. The projection in the recess forms part of the soft midsole in order to provide the best possible walking comfort. If the heel part only included the projection and the material thereof, the shoe sole and consequently the entire shoe would have a very short life.

According to the invention the projection is substantially wedge-shaped when seen in the horizontal plane, i.e. preferably with a rounded front end and rear end, and the lower surface of the projection is substantially plane and forms a solid angle with the walking surface of between 10° and −10° when the shoe is not exposed to pressure. In this manner the projection and the walking surface come into contact with one another with their surfaces which ensures a minimum wear of the projection.

Furthermore the projection of the shoe sole may according to the invention be patterned on the lower surface, whereby the contact with the walking surface is improved.

In addition according to the invention a recess may encircle the projection, whereby a better resilience and a reduced shock-sensitivity than previously are achieved.

A further advantage of the shoe sole according to the invention is that the lower surface of the projection corresponds to 15–40%, preferably approximately 20%, of the projected area of the recess on the walking surface. According to the invention the recess may be asymmetrically situated relative to the walking direction and the longitudinal circumferential rims. As a result the resilience can be adapted to the shock effects.

Yet another advantage of the shoe sole according to the invention is that it is made of a foamed plastics, as well as that the projection is of a length of 30–60 mm in the walking direction, preferably 45 mm, and that the largest width of the projection perpendicular to the walking direction is 30–50 mm, preferably 35 mm, and that the projection is of a height of 2–10 mm, preferably 5 mm, and that the maximum depth of the recess is 5–15 mm, preferably 9.5 mm.

BRIEF DESCRIPTION OF DRAWINGS

The invention is described in greater detail below with reference to the accompanying drawing, in which.

BEST MODE FOR CARRYING OUT THE INVENTION

Figure 1:
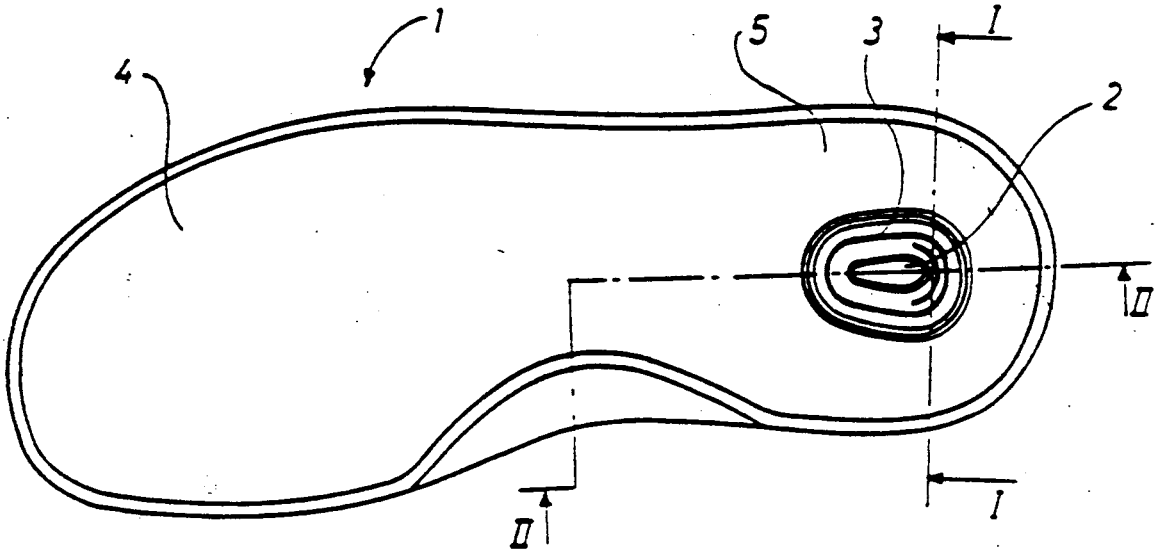
FIG. 1 is a bottom view of a shoe sole according to the invention.
Figure 2:
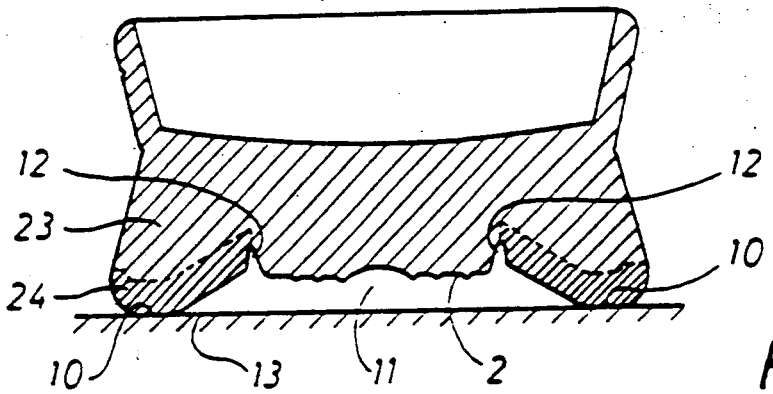
FIG. 2 is a sectional view of the sole of FIG. 1 taken along the line I—I of FIG. 1.

The shoe sole 1 of FIG. 2 comprises a forefoot area 4 and a heel area 5. The heel area 5 comprises a patterned 3 projection 2, the pattern of the projection including both ribs and grooves and optionally raised characters.

FIG. 2 illustrates the shoe sole 1 under usual pressure loads. The shoe sole comprises two longitudinal circumferential rims 10 resting on a walking surface 13. The projection 2 is situated in a recess 11 between two longitudinal circumferential rims 10. Under usual pressure loads the projection 2 does not come into contact with the walking surface 13. A recess 12 encircles the projection 2, said recess providing the projection with an additional resilience and counter-acting the sensitivity to shocks.

Figure 3:
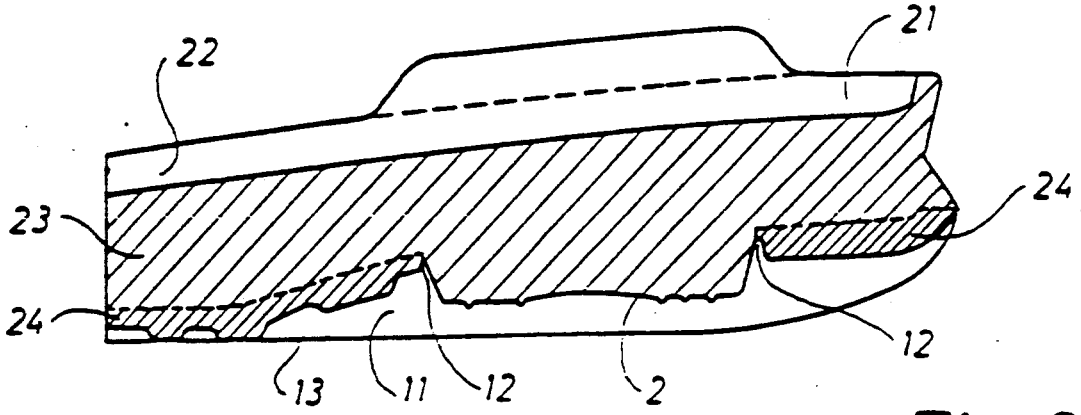
FIG. 3 is a sectional view of the sole of FIG. 1 taken along the line II—II of FIG. 1.

The shoe sole 1 of FIG. 3 comprises an area 21 in which the heel of the user is placed, and an area 22 in which the forefoot of the user is placed. The recess 11 extends from behind the heel 21 and forward to the forefoot 22. The shoe sole 1 comprises a midsole 23 and an outsole 24. The midsole 23 may be of a highly varying thickness, whereas the outsole 24 is of an approximately constant thickness. The midsole 23 adapts the surface of the foot sole to the walking surface 13, while the outsole 24 is only of a thickness providing a suitably long life of the entire sole.

The recess 11 of the shoe sole 1 extends from below the heel 21 and forward to the forefoot 22. When the user of the shoe is standing on a walking surface 13 only the longitudinal circumferential rims of the shoe sole come into contact with the walking surface 13, said rims extending along the heel. The shock-absorbing projection 2 does not come into contact with the walking surface 13 at low compressive load, i.e. when the user stands with both feet on the ground 13. At high compressive load, i.e. for instance during walking or running, where the entire weight of the user is on one heel for a short period, the shock-absorbing projection 2 comes into contact with the ground 13. In this manner it is ensured that the user stands firm in the best possible manner, that the weight of the user is transferred to the heel bone in the best possible manner, and that the shocks are absorbed in the best possible manner. The projection 2 forms part of the midsole 23. The outsole 24 is situated below the midsole 23. Usually the outsole comes into contact with the ground 13. The outsole is made of a hard-wearing material possessing relatively poor shock-absorbing capacities. The projection 2 extends through a hole or a rim recess in the outsole 24. In this manner the soft and less hard-wearing material of the midsole 23 can come into contact with the ground 13.

When seen in horizontal direction the projection 2 is substantially wedge-shaped with rounded front and back parts. The shape of the projection 2 is adapted to the heel bone, i.e. it is almost pear-shaped. The bottom surface of the projection 2 is planar when the shoe is not loaded and can form a predetermined angle with the ground 13 so as to transfer the stresses at a high compressive load in the best possible manner.

The projection 2 is patterned on its bottom surface.

As illustrated in FIGS. 2 and 3 a recess 12 may extend round or only along part of the projection 2. The bottom surface of the projection corresponds to 15–40%, about 20% in the illustrated embodiment, of the projected area of the recess 11 on the ground 13.

The recess 11 is asymmetrically situated relative to the walking direction and the longitudinal circumferential rims 10. The recess 11 can also be inclined relative to the longitudinal circumferential rims 10.

The projection 2 is of a length of 30–60 mm in the walking direction, 45 mm in the illustrated embodiment. The largest width of the projection 2 perpendicular to the walking direction is 30–50 mm, 35 mm in the illustrated embodiment. The projection 2 is of a height of 2–10 mm, 5 mm in the illustrated embodiment. The maximum depth of the recess 11 is 5–15 mm, 9.5 mm in the illustrated embodiment. The deepest portion of the recess is situated farthest off on the heel.

The shoe sole is made of a foamed plastics, such as polyurethane foam. The recess 11 may form part of a cylindrical surface of a circular or elliptical cross section. In the drawing the projection 2 is almost pear-shaped, but it may also be wedge-shaped or triangular. In the drawing the bottom surface of the projection is parallel to the ground 13, but it may also form a solid angle with said ground 13 in the range 10° to −10° (not shown). As mentioned the projection 2 may be provided with a pattern 3 in the form of for instance ribs, webs, knobs or raised letters.

The invention may be varied in many ways without thereby deviating from the scope thereof. Thus for instance the projection 2 may comprise one or more relatively large cavities or the recesses 12 may be very deep or wide.

I claim:

1. A sole for use in a shoe, comprising:

a heel;

a forefoot forward of said heel;

a midsole;

an outsole below said midsole and having an opening therein at said heel;

a ground-contacting surface comprising a pair of longitudinal circumferential rims extending circumferentially on either side of said outsole;

an axial recess formed in said midsole and said outsole extending inwardly of said rims along the length of said heel and terminating at said forefoot, said axial recess allowing only said longitudinal circumferential rims below said heel to come into contact with the ground when a wearer of the shoe is standing on the ground; and a shock-absorbing projection forming part of said midsole and extending through said opening in said outsole into said axial recess, said projection being substantially wedge-shaped in transverse cross-section, and said projection only coming into contact with the ground at a high pressure load when the entire weight of the wearer is on one heel for a short period, said axial recess preventing said projection from coming into contact with the ground at low compressive loads when the wearer stands with both feet on the ground, wherein said projection has a substantially planar lower surface, and wherein said lower surface forms a solid angle with the ground of between 10° and −10° when said sole is not subjected to pressure;

said opening in said outsole and said projection being positioned to be opposite the heel bone of the foot of the wearer; and said sole being manufactured of a resilient material.

2. A sole for use in a shoe, comprising:

a heel;

a forefoot forward of said heel;

a midsole;

an outsole below said midsole and having an opening therein at said heel;

a ground-contacting surface comprising a pair of longitudinal circumferential rims extending circumferentially on either side of said outsole;

an axial recess formed in said midsole and said outsole extending forwardly and rearwardly of said opening and inwardly of said rims along the length of said heel and terminating at said forefoot, said axial recess allowing only said longitudinal circumferential rims below said heel to come into contact with the ground when a wearer of the shoe is standing on the ground; and a shock-absorbing projection forming part of said midsole and extending through said opening in said outsole into said axial recess, said projection being substantially wedge-shaped in transverse cross-section, and said projection only coming into contact with the ground at a high pressure load when the entire weight of the wearer is on one heel for a short period, said axial recess preventing said projection from coming into contact with the ground at low compressive loads when the wearer stands with both feet on the ground, wherein said projection has a patterned lower surface;

said opening in said outsole and said projection being positioned to be opposite the heel bone of the foot of the wearer; and said sole being manufactured of a resilient material.

3. A sole for use in a shoe, comprising:

a heel;

a forefoot forward of said heel;

a midsole;

an outsole below said midsole and having an opening therein at said heel;

a ground-contacting surface extending circumferentially on either side of said outsole;

an axial recess formed in said midsole and said outsole extending inwardly of said ground-contacting surface along the length of said heel and terminating at said forefoot; and a shock-absorbing projection forming part of said midsole and extending through said opening in said outsole into said axial recess to a point above said ground-contacting surface, said projection having a transverse cross-section adapted to the heel bone, wherein said projection has a patterned lower surface;

said opening in said outsole and said projection being positioned to be opposite the heel bone of the foot of the wearer; and said sole being manufactured of a resilient material.

4. A sole for use in a shoe, comprising:

a heel;

a forefoot forward of said heel;

a midsole;

an outsole below said midsole and having an opening therein at said heel;

a ground-contacting surface extending circumferentially on either side of said outsole;

an axial recess formed in said midsole and said outsole extending inwardly of said ground-contacting surface along the length of said heel and terminating at said forefoot; and a shock-absorbing projection forming part of said midsole and extending through said opening in said outsole into said axial recess to a point above said ground-contacting surface, said projection having a transverse cross-section adapted to the heel bone, wherein said projection has a substantially planar lower surface, and wherein said lower surface forms a solid angle with the ground of between 10° and −10° when said sole is not subjected to pressure;

said opening in said outsole and said projection being positioned to be opposite the heel bone of the foot of the wearer; and said sole being manufactured of a resilient material.

5. A sole for use in a shoe, comprising:

a heel;

a forefoot forward of said heel;

a midsole;

an outsole below said midsole and having an opening therein at said heel;

a ground-contacting surface extending circumferentially on either side of said outsole;

an axial recess formed in said midsole and said outsole extending inwardly of said ground-contacting surface along the length of said heel and terminating at said forefoot; and a shock-absorbing projection forming part of said midsole and extending through said opening in said outsole into said axial recess to a point above said ground-contacting surface, said projection having a transverse cross-section adapted to the heel bone, wherein said projection has a length of 30–60 mm. in the walking direction, and wherein the greatest width of said projection perpendicular to the walking direction is 30–50 mm., and wherein said projection has a height of 2–22 mm., and wherein the maximum depth of said axial recess is 5–15 mm.;

said opening in said outsole and said projection being positioned to be opposite the heel bone of the foot of the wearer; and said sole being manufactured of a resilient material.

6. The sole of claim 5, wherein said projection has a length of approximately 45 mm. in the walking direction, and wherein the greatest width of said projection perpendicular to the walking direction is approximately 35 mm., and wherein said projection has a height of approximately 5 mm., and wherein the maximum depth of said axial recess is approximately 9.5 mm.

7. A sole for use in a shoe, comprising:

a heel;

a forefoot forward of said heel;

a midsole;

an outsole below said midsole and having an opening therein at said heel;

a ground-contacting surface comprising a pair of longitudinal circumferential rims extending circumferentially on either side of said outsole;

an axial recess formed in said midsole and said outsole extending inwardly of said rims along the length of said heel and terminating at said forefoot, said axial recess allowing only said longitudinal circumferential rims below said heel to come into contact with the ground when a wearer of the shoe is standing on the ground; and a shock-absorbing projection forming part of said midsole and extending through said opening in said outsole into said axial recess, said projection being substantially wedge-shaped in transverse cross-section, and said projection only coming into contact with the ground at a high pressure load when the entire weight of the wearer is on one heel for a short period, said axial recess preventing said projection from coming into contact with the ground at low compressive loads when the wearer stands with both feet on the ground, wherein said projection has a length of 30–60 mm. in the walking direction, and wherein the greatest width of said projection perpendicular to the walking direction is 30–50 mm., and wherein said projection has a height of 2–10 mm., and wherein the maximum depth of said axial recess is 5–15 mm.;

said opening in said outsole and said projection being positioned to be opposite the heel bone of the foot of the wearer; and said sole being manufactured of a resilient material.

8. The sole of claim 7, wherein said projection has a length of approximately 45 mm. in the walking direction, and wherein the greatest width of said projection perpendicular to the walking direction is approximately 35 mm., and wherein said projection has a height of approximately 5 mm., and wherein the maximum depth of said axial recess is approximately 9.5 mm.

9. A sole for use in a shoe, comprising:

a heel;

a forefoot forward of said heel;

a midsole;

an outsole below said midsole and having an opening therein at said heel;

a ground-contacting surface comprising a pair of longitudinal circumferential rims extending circumferentially on either side of said outsole;

an axial recess formed in said midsole and said outsole extending inwardly of said rims along the length of said heel and terminating at said forefoot, said axial recess allowing only said longitudinal circumferential rims below said heel to come into contact with the ground when a wearer of the shoe is standing on the ground; and a shock-absorbing projection forming part of said midsole and extending through said opening in said outsole into said axial recess, said projection being substantially wedge-shaped in transverse cross-section, and said projection only coming into contact with the ground at a high pressure load when the entire weight of the wearer is on one heel for a short period, said axial recess preventing said projection from coming into contact with the ground at low compressive loads when the wearer stands with both feet on the ground, wherein said projection has a lower surface corresponding to 15–40% of a projection of the area of said axial recess on the ground;

said opening in said outsole and said projection being positioned to be opposite the heel bone of the foot of the wearer; and said sole being manufactured of a resilient material.

10. The sole of claim 9, wherein said projection has rounded front and rear ends.

11. The sole of claim 9, wherein said projection has a substantially planar lower surface, and wherein said lower surface is substantially parallel to the ground when said sole is not subjected to pressure.

12. The sole of claim 9, further comprising a circumferential recess encircling said projection.

13. The sole of claim 9, wherein said projection has a lower surface corresponding to approximately 20% of a projection of the area of said axial recess on the ground.

14. The sole of claim 9, wherein said axial recess is asymmetrically situated relative to the walking direction and said rims.

15. The sole of claim 9, wherein said sole is made of a foamed plastic.

16. A sole for use in a shoe, comprising:

a heel;

a forefoot forward of said heel;

a midsole;

an outsole below said midsole and having an opening therein at said heel;

a ground-contacting surface extending circumferentially on either side of said outsole;

an axial recess formed in said midsole and said outsole extending inwardly of said ground-contacting surface along the length of said heel and terminating at said forefoot; and a shock-absorbing projection forming part of said midsole and extending through said opening in said outsole into said axial recess to a point above said ground-contacting surface, said projection having a transverse cross-section adapted to the heel bone, wherein said projection has a lower surface corresponding to 15–40% of a projection of the area of said axial recess on the ground;

said opening in said outsole and said projection being positioned to be opposite the heel bone of the foot of the wearer; and said sole being manufactured of a resilient material.

17. The sole of claim 16, wherein said projection has a substantially planar lower surface, and wherein said lower surface is substantially parallel to the ground when said sole is not subjected to pressure.

18. The sole of claim 16, further comprising a circumferential recess encircling said projection.

19. The sole of claim 16, wherein said projection has a lower surface corresponding to approximately 20% of a projection of the area of said axial recess on the ground.

20. The sole of claim 16, wherein said axial recess is asymmetrically situated relative to the walking direction and said rims.

21. The sole of claim 16, wherein said sole is made of a foamed plastic.

* * * * *